US011466544B2

(12) United States Patent
Rodriguez et al.

(10) Patent No.: US 11,466,544 B2
(45) Date of Patent: Oct. 11, 2022

(54) LATERAL LOCATING ASSEMBLY FOR LATERAL INTERVENTION

(71) Applicant: Halliburton Energy Services, Inc., Houston, TX (US)

(72) Inventors: Franklin Charles Rodriguez, Pinehurst, TX (US); Neil Hepburn, Newcastle-Upon-Tyne (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/174,628

(22) Filed: Feb. 12, 2021

(65) Prior Publication Data

US 2022/0259949 A1 Aug. 18, 2022

(51) Int. Cl.

| | |
|---|---|
| ***E21B 41/00*** | (2006.01) |
| ***E21B 17/05*** | (2006.01) |
| *E21B 31/14* | (2006.01) |
| *E21B 17/06* | (2006.01) |
| *E21B 23/00* | (2006.01) |

(52) U.S. Cl.

CPC ..... *E21B 41/0035* (2013.01); *E21B 17/05* (2013.01); *E21B 17/06* (2013.01); *E21B 23/006* (2013.01); *E21B 31/14* (2013.01)

(58) Field of Classification Search

CPC ..... E21B 17/05; E21B 17/06; E21B 17/20; E21B 23/006; E21B 31/14; E21B 41/0035

See application file for complete search history.

(56) References Cited

U.S. PATENT DOCUMENTS

| | | | | |
|---|---|---|---|---|
| 4,836,303 | A | 6/1989 | Boulet et al. | |
| 6,244,340 | B1 | 6/2001 | McGlothen et al. | |
| 6,279,659 | B1 | 8/2001 | Brunet | |
| 6,527,067 | B1 | 3/2003 | Ravensbergen et al. | |
| 7,299,864 | B2 | 11/2007 | Pratt et al. | |
| 7,445,059 | B1 * | 11/2008 | Falgout, Sr. ..... | E21B 7/067 175/74 |
| 7,757,782 | B2 | 7/2010 | Tashiro et al. | |
| 9,206,649 | B1 | 12/2015 | Zupanick | |
| 9,464,482 | B1 | 10/2016 | Bargach et al. | |
| 9,945,190 | B2 | 4/2018 | Crowley et al. | |
| 10,018,004 | B2 | 7/2018 | Abrant et al. | |
| 10,612,330 | B2 | 4/2020 | Wheater et al. | |
| 2001/0042621 | A1 | 11/2001 | Leising | |

(Continued)

FOREIGN PATENT DOCUMENTS

| | | |
|---|---|---|
| WO | 9809048 | 3/1998 |
| WO | 2014078364 A2 | 5/2014 |
| WO | 2015061047 A1 | 4/2015 |

*Primary Examiner* — Robert E Fuller
*Assistant Examiner* — Lamia Quaim
(74) *Attorney, Agent, or Firm* — Scott Richardson; Parker Justiss, P.C.

(57) ABSTRACT

Provided, in one aspect, is a lateral locating assembly. The lateral locating assembly may include, in one aspect, a housing, as well as a piston positioned within the housing. The lateral locating assembly according to this aspect may further include a mandrel extending from a distal end of the housing, the mandrel configured to rotate and translate angularly in response to the piston moving from a first position to a second position, and a deflection tip coupled with a distal end of the mandrel, the deflection tip configured to rotate and angularly translate with the mandrel relative to the housing.

23 Claims, 10 Drawing Sheets

(56) References Cited

U.S. PATENT DOCUMENTS

| | | | |
|---|---|---|---|
| 2003/0034178 | A1 | 2/2003 | Cargill et al. |
| 2013/0014957 | A1 | 1/2013 | Hallundbaek et al. |
| 2014/0190688 | A1 | 7/2014 | Cronley et al. |

* cited by examiner

LATERAL LOCATING ASSEMBLY FOR LATERAL INTERVENTION

BACKGROUND

Multilateral wells include one or more lateral wellbores extending from a main wellbore. A lateral wellbore is a wellbore that is diverted from the main wellbore. A multilateral well may include one or more windows or casing exits to allow corresponding lateral wellbores to be formed. A deflected window mill penetrates part of the casing joint to form the window or casing exit in the casing string and is then withdrawn from the wellbore. Downhole assemblies can be subsequently deflected out the casing exit in order to drill and complete the lateral wellbore, fracture the lateral wellbore, and/or service the lateral wellbore.

BRIEF DESCRIPTION

Reference is now made to the following descriptions taken in conjunction with the accompanying drawings, in which.

DETAILED DESCRIPTION

A subterranean formation containing oil and/or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased (e.g., open-hole) portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers to a direction that is towards the surface of the well, while the term "downhole" refers to a direction that is away from the surface of the well.

Figure 1:
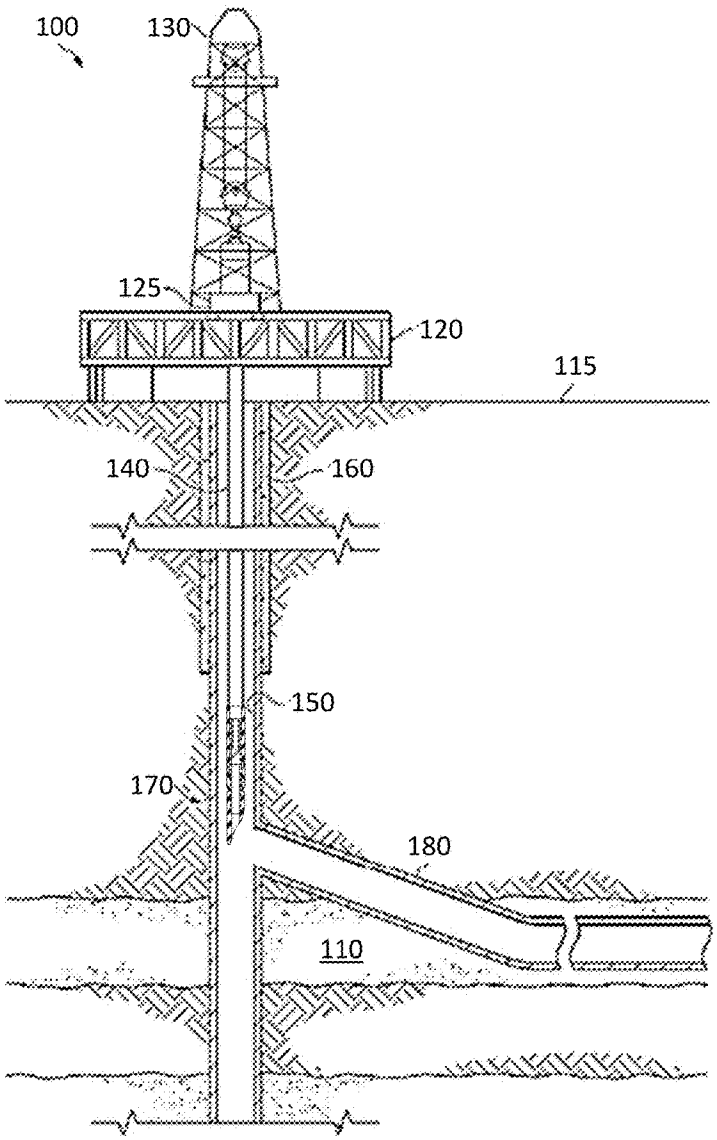
FIG. 1 is a schematic view of a multilateral well according to one or more embodiments disclosed herein.

FIG. 1 is a schematic view of a multilateral well 100 according to one or more embodiments disclosed herein. The multilateral well 100 includes a platform 120 positioned over a subterranean formation 110 located below the earth's surface 115. The platform 120, in at least one embodiment, has a hoisting apparatus 125 and a derrick 130 for raising and lowering pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A lateral locating assembly 170 according to one or more embodiments of the present disclosure may be positioned at a location in the main wellbore 150. Specifically, the lateral locating assembly 170 would be placed at a location in the main wellbore 150 where an exit window may be milled for access to a lateral wellbore 180. Accordingly, the lateral locating assembly 170 may be used to support one or more tools accessing the lateral wellbore 180. In some embodiments, the lateral locating assembly 170 may include an inner diameter running there through for fluid access and may also provide access through the lateral locating assembly 170 for passage of downhole tools there through, for example without needing support from a whipstock or traditional deflectors or deviation systems. In fact, the well system 100 of FIG. 1 may operate without any whipstocks or deflectors in one or more embodiments of the disclosure.

The lateral locating assembly 170, in one or more embodiments, may include a housing and a piston positioned within the housing. A mandrel may extend from a distal end of the housing, and the mandrel may be configured to rotate and translate angularly in response to the piston moving from a first position to a second position. A deflection tip may be coupled with a distal end of the mandrel, the deflection tip configured to rotate and angularly translate with the mandrel relative to the housing. When the lateral locating assembly 170 reaches the exit window for the lateral wellbore 180, an axial force may be applied to the piston to move the piston from the first positon to the second position, thereby rotating the mandrel and deflection tip. An angled inner surface in a distal end of the housing may be configured to engage a ramp positioned on an outer surface of the mandrel such that as the mandrel and the deflection tip coupled thereto rotate, the mandrel and deflection tip may also translate angularly with respect to the housing and into the lateral wellbore 180.

Figure 2A:
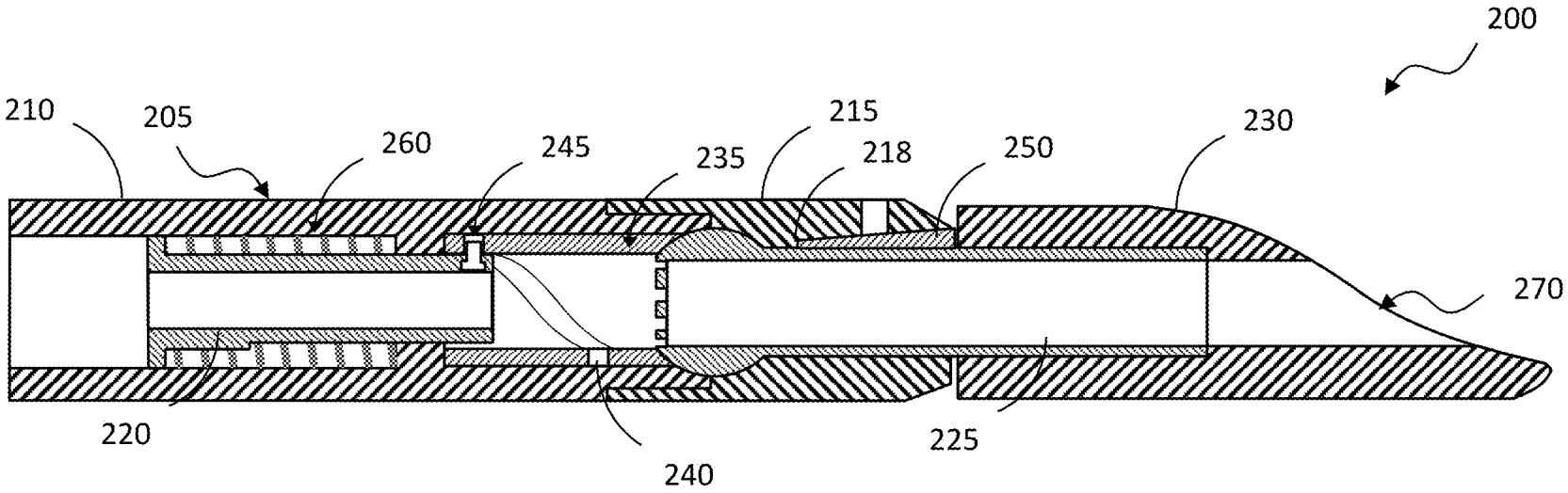
FIG. 2A illustrates a lateral locating assembly designed and manufactured according to one or more embodiments of the disclosure, for example shown in a run in hole state.
Figure 2B:
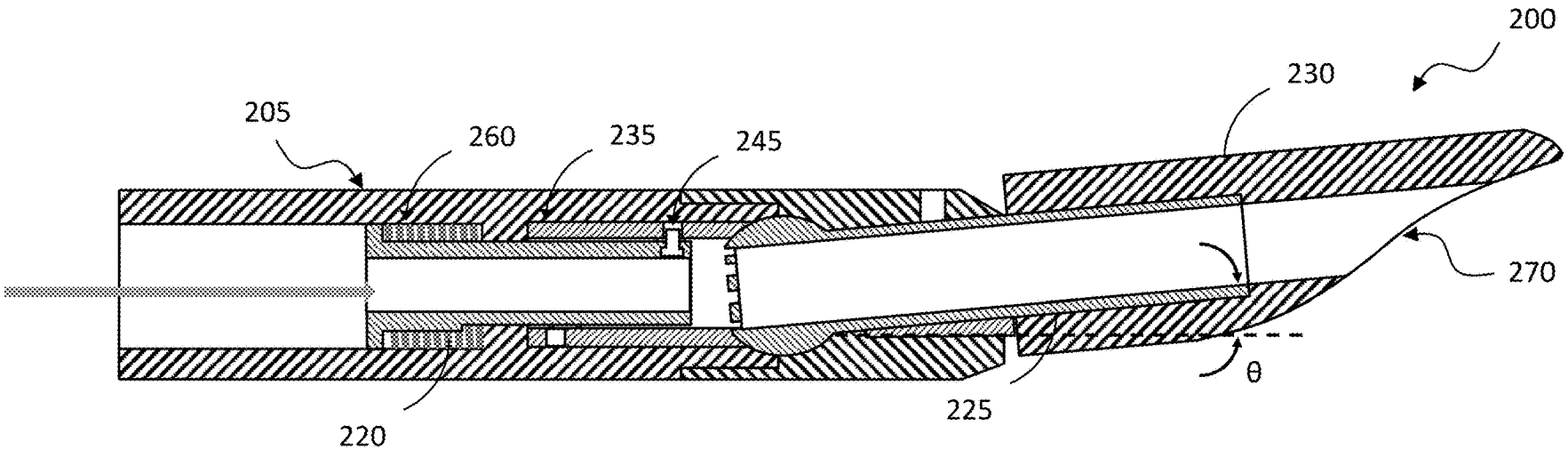
FIG. 2B illustrates the lateral locating assembly shown in FIG. 2A in a deflected state.

Turning now to FIGS. 2A and 2B, there is shown one embodiment of a lateral locating assembly 200 designed and manufactured according to one or more embodiments of the disclosure. The lateral locating assembly 200 is shown in FIG. 2A in a run in hole state and shown in FIG. 2B in a deflected state. The lateral locating assembly 200, in one embodiment, may include a housing 205. Positioned within the housing 205 may be a piston 220, the piston 220 configured to move from a first position as shown in FIG. 2A to a second position as shown in FIG. 2B. In some embodiments, a mandrel 225 may extend from a distal end of the housing 205, the mandrel 225 configured to rotate and translate angularly in response to the piston 220 moving from the first position to the second position. In some embodiments, the mandrel may rotate about 180 degrees relative to the housing 205.

A deflection tip 230 may be coupled with a distal end of the mandrel 225 and configured to rotate and angularly translate with the mandrel 225 relative to the housing 205 as the piston 220 moves from the first position to the second position. The deflection tip 230 is illustrated in FIGS. 2A and 2B is a separate feature. Nevertheless, other embodiments may exist wherein the deflection tip and the mandrel 225 are single feature. In certain embodiments, the deflection tip 230 is configured to rotate by about 180 degrees and angularly translate by an angle (θ) of at least about 5 degrees as the piston moves from the first position to the second position. In some other embodiments, the deflection tip 230 may be configured to rotate eccentrically by about 180 degrees and angularly translate by an angle (θ) of at least about 5 degrees.

In the illustrated embodiment, a rotating transmission sleeve 235 may be coupled between the piston 220 and the mandrel 225. The rotating transmission sleeve 235 may include a helical channel 240. The helical channel 240 may engage a protrusion 245 on the piston 220 such that the helical channel 240 may follow the protrusion 245 and rotate the rotating transmission sleeve 235 as the piston 220 moves from the first position to the second position. As the rotating transmission sleeve 235 rotates, the mandrel 225 and the deflection tip 230 may likewise rotate and angularly translate relative to the housing 205.

In some embodiments, the housing 205 may include a piston housing 210 on a proximal end thereof and a separate eccentric housing 215. The eccentric housing 215, in one or more embodiments, may include an angled inner surface 218.

In the illustrated embodiment a ramp 250 (e.g., eccentric ramp) may be coupled on an outer surface of the mandrel 225. The ramp 250 may be configured to engage the angled inner surface 218 of the housing 205 as the mandrel 225 rotates, and thereby angularly translate the mandrel 225 relative to the housing 205. In this embodiment, the piston 220 may be maintained in the first position by a spring 260 and as such the deflection tip 230 is maintained in a neutral, run in hole state. An axial (linear) force may be applied to the piston 220, which may compress the spring 260 and thereby move the piston 220 from the first position shown in FIG. 2A to the second position shown in FIG. 2B.

In some embodiments, there may be a need for fluid access through the lateral locating assembly 200, and in other embodiments full downhole tool access may be needed through the lateral locating assembly 200. A longitudinal passageway 270 may extend through the features of the lateral locating assembly 200, including the piston 220, the rotating transmission sleeve 235, the mandrel, and the deflection tip 230. In some embodiments, the longitudinal passageway 270 may have a minimum diameter (d) of at least 12 mm.

When lateral intervention is no longer necessary, the lateral locating assembly 200 may in some embodiments be returned to the run in hole, or neutral, position shown in FIG. 2A, wherein the piston 220 may be returned from the second position back to the first position. As such, the deflection tip 230 may be rotated and angularly translated from the deflected state shown in FIG. 2B back to the run in hole position shown in FIG. 2A. The lateral locating assembly 200 may then be retrieved uphole, or may be positioned at another location within the wellbore for access of another lateral wellbore portion. The lateral locating assembly 200 may accordingly provide access to at least one lateral wellbore without the need for other downhole tools, such as a whipstock or other supporting tools, and thus, additional trips into the wellbore by a drill string or downhole conveyance may not be required.

Figure 3A:
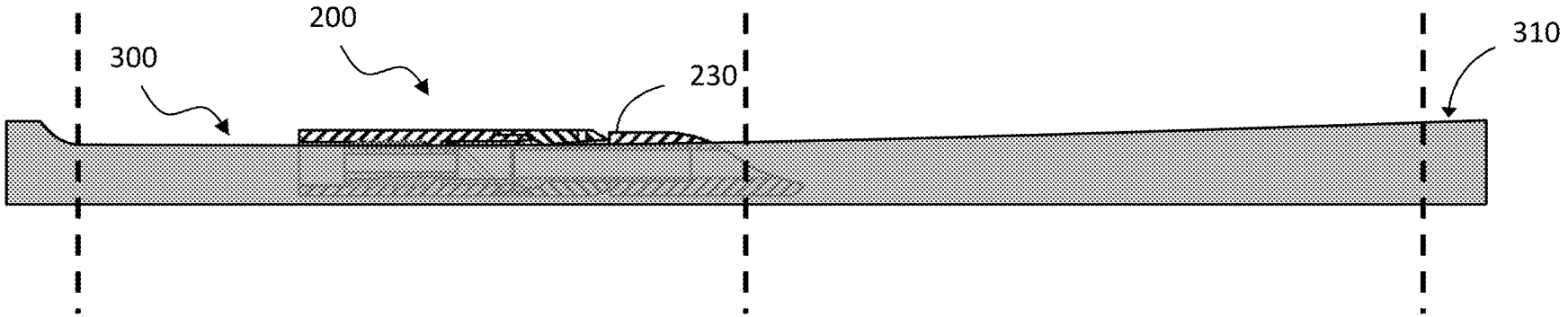
FIGS. 3A through 3E illustrate the lateral locating shown in FIG. 2A shown in various positions transitioning from a first run in hole state to a final deflected state.
Figure 3B:
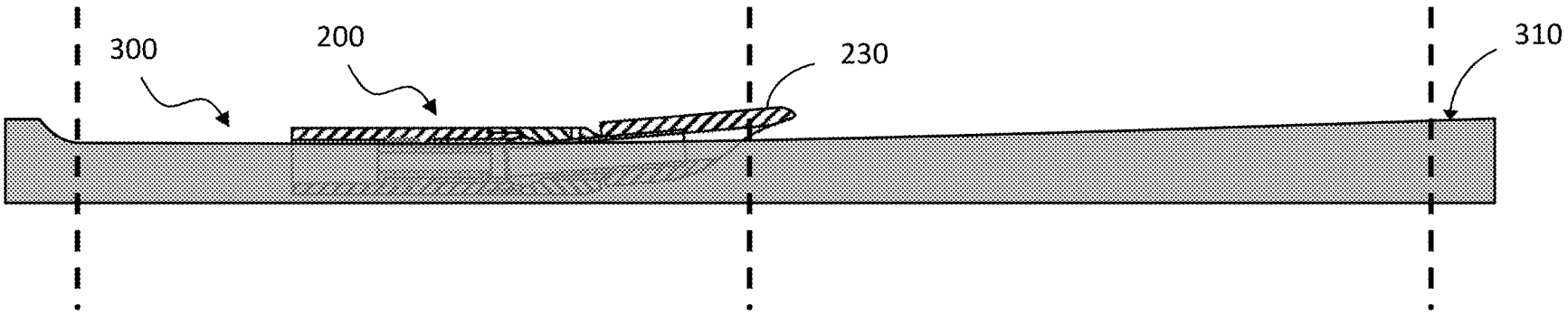
Figure 3C:
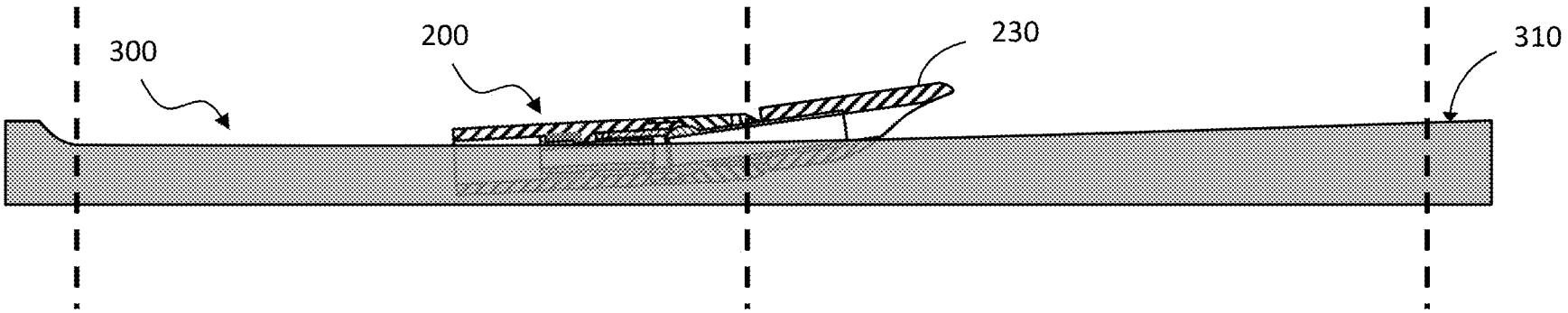
Figure 3D:
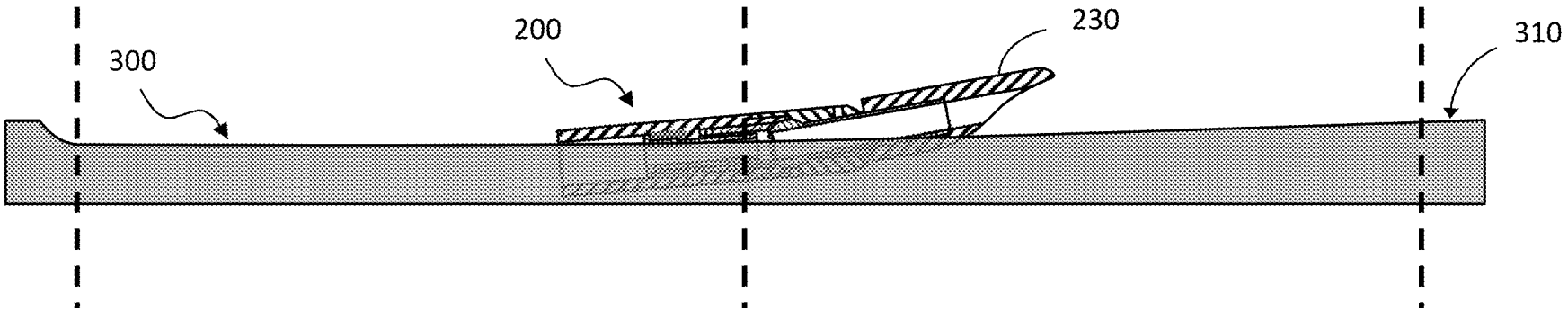
Figure 3E:
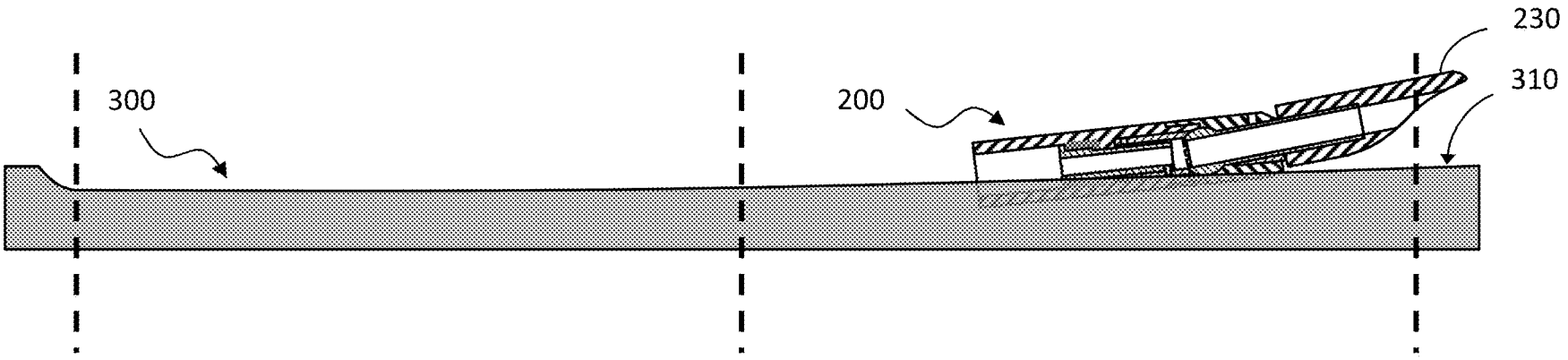

Turning now to FIGS. 3A through 3E, an example of the lateral locating assembly 200 is shown in various operational states and reference depths with respect to a window 300 to a lateral wellbore 310. FIG. 3A illustrates the lateral locating assembly 200 in a neutral, run in hole state, wherein the deflection tip 230 is in a non-deflected position. In the illustrated example, the reference depth of the deflection tip 230 with respect to the window 300 may be about 0 cm. FIG. 3B illustrates the lateral locating assembly 200 in a deflected state wherein the deflection tip 230 has rotated and translated angularly into a deflected position, and beginning to deviate through the window 300 into the lateral wellbore 310, in this example, at a reference depth of about 2 cm (0.756 in.) with respect to the window 300. FIG. 3C illustrates the lateral locating assembly 200 with the deflection tip 230 in a deflected position as the lateral locating assembly 200 deviates into the lateral wellbore 310 at a reference depth, in this example, of about 35.66 cm (1.17 ft.) through the window 300. FIG. 3D illustrates the lateral locating assembly 200 in a deflected position partially deviated into the lateral wellbore 310 at a reference depth of about 60.05 cm (1.97 ft.) with respect to the window 300. FIG. 3E illustrates the lateral locating assembly 200 in a deflected position with the deflection tip 230 substantially deviated (deviated between about 90-100%) into the lateral wellbore 310 at a reference depth of about 155.45 cm (5.10 ft.) with respect to the window 300. The lateral wellbore 310 may now be accessed for fluid passage and/or accessed by downhole tools through the lateral locating assembly 200.

Figure 4:
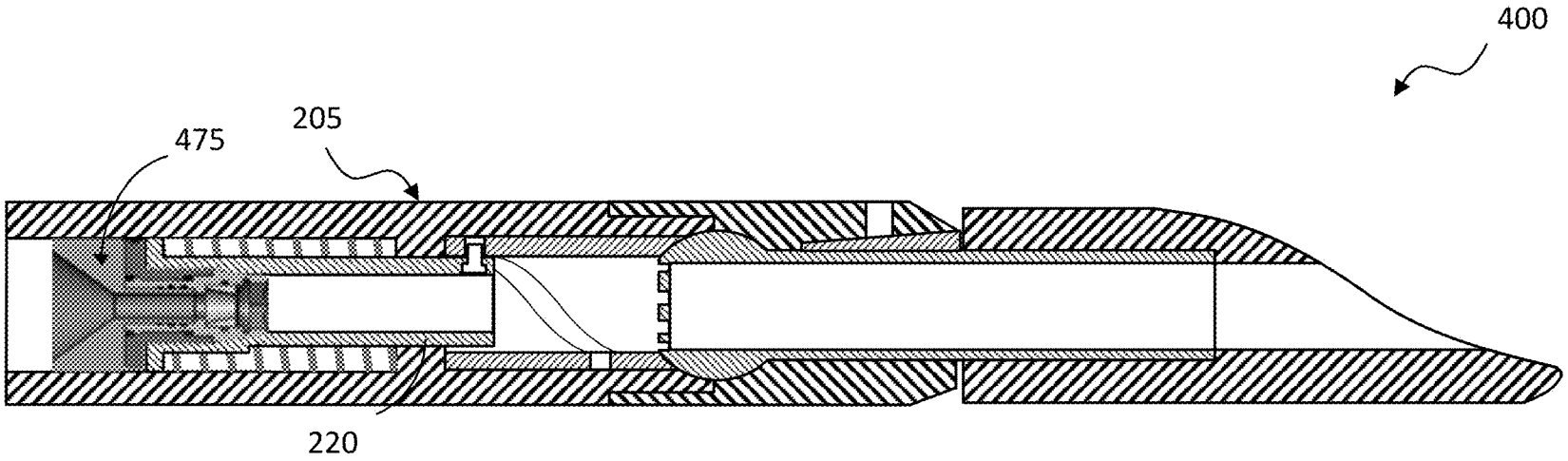
FIG. 4 illustrates a lateral locating assembly designed and manufactured according to one or more alternate embodiments of the disclosure.

Turning now to FIG. 4, there is shown another embodiment of a lateral locating assembly 400 according to principles of the disclosure. The lateral locating assembly 400 is similar in many respects to the lateral locating assembly 200 of FIGS. 2A-2B. Accordingly, like reference numbers have been used to reference similar, if not identical, features. The lateral locating assembly 400 differs, for the most part, from the lateral locating assembly 200, in that the lateral locating assembly 400 includes a fluid nozzle assembly 475 positioned within the housing 205 at an uphole end of the piston 220. In some embodiments, the fluid nozzle assembly 475 may increase pressure on the piston 220, in order to urge the piston 220 from the first position to the second position. The fluid nozzle assembly 475 may activate the piston 220 due to differential pressure in the wellbore. In some embodiments, the fluid nozzle assembly 475 may be needed when more force is required to urge the piston 220 from the first position (e.g., when there may be a smaller cross section in the wellbore over which fluid flow is available). In addition, various sizes of nozzles may be used in the fluid nozzle assembly 475 according to different environments and configurations in which the lateral locating assembly 400 may be placed.

Figure 5:
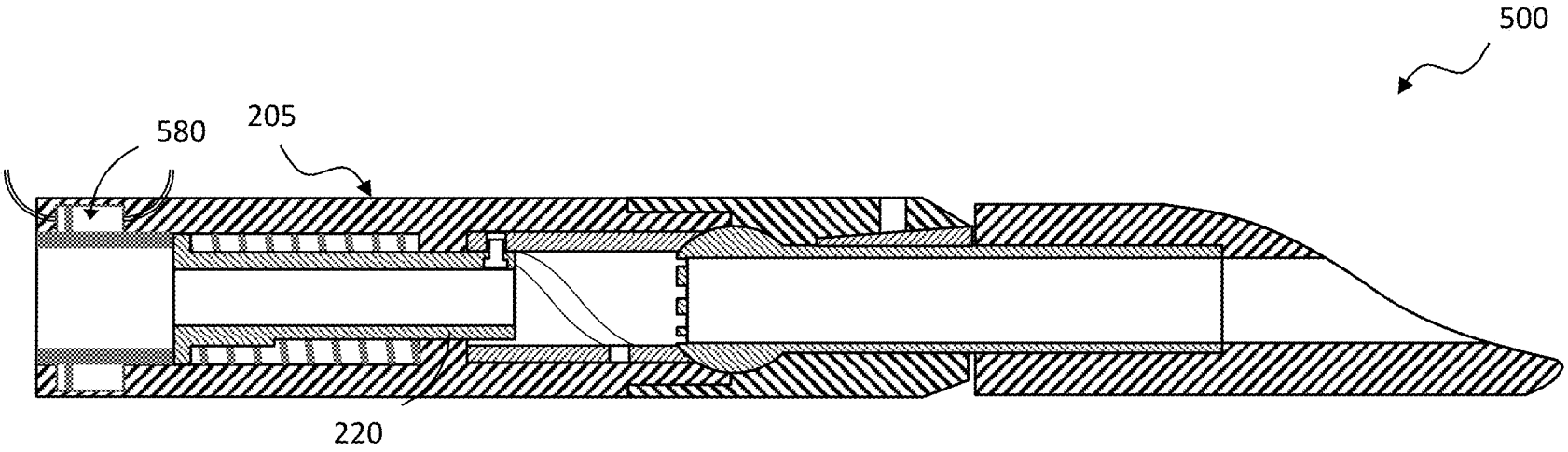
FIG. 5 illustrates another lateral locating assembly designed and manufactured according to one or more alternate embodiments of the disclosure.

Turning now to FIG. 5, there is shown another embodiment of a lateral locating assembly 500 according to principles of the disclosure. The lateral locating assembly 500 is similar in many respects to the lateral locating assembly 200 of FIGS. 2A-2B. Accordingly, like reference numbers have been used to reference similar, if not identical, features. The lateral locating assembly 500 differs, for the most part, from the lateral locating assembly 200, in that the lateral locating assembly 500 includes a hydraulic power unit 580 coupled uphole of the piston 220. The hydraulic power unit 580 may be configured to mechanically move the piston 220 from the first position to the second position. In some embodiments, the hydraulic power unit 580 may be programmable to mechanically move the piston 220 from the first position to the second position after one or more pressure cycles thereon. The programming of hydraulic power unit 580 may depend on signature pressure amounts or cycles determined according to anticipated environments and configurations in which the lateral locating assembly 500 may be placed. The hydraulic power unit 580, in some embodiments, may be actuated remotely using applied surface pressure. In other embodiments, the hydraulic power unit 580 may be actuated by hydrostatic pressure and may include actuation by a timer.

Aspects disclosed herein include:

A. A lateral locating assembly, the lateral locating assembly including: 1) a housing; 2) a piston positioned within the housing; 3) a mandrel extending from a distal end of the housing, the mandrel configured to rotate and translate angularly in response to the piston moving from a first position to a second position; and 4) a deflection tip coupled with a distal end of the mandrel, the deflection tip configured to rotate and angularly translate with the mandrel relative to the housing.

B. A method of wellbore intervention, the method including: 1) running a lateral locating assembly into a main wellbore, the lateral locating assembly including: a) a housing; b) a piston positioned within the housing; c) a mandrel extending from a distal end of the housing, the mandrel configured to rotate and translate angularly in response to the piston moving from a first position to a second position; and c) a deflection tip coupled with a distal end of the mandrel, the deflection tip configured to rotate and angularly translate with the mandrel relative to the housing; 2) moving the piston from the first position to the second position at a desired location in the main wellbore to rotate and angularly translate the deflection tip relative to the housing; and 3) pushing the lateral locating assembly having the rotated and angularly translated deflection tip though a window in the main wellbore and into a lateral wellbore.

C. A well system, the well system including: 1) a main wellbore; 2) a lateral wellbore extending from the main wellbore; and 3) a lateral locating assembly located in the main wellbore, the lateral locating assembly including: a) a housing; b) a piston positioned within the housing; c) a mandrel extending from a distal end of the housing, the mandrel configured to rotate and translate angularly in response to the piston moving from a first position to a second position; and d) a deflection tip coupled with a distal end of the mandrel, the deflection tip configured to rotate and angularly translate with the mandrel relative to the housing.

Aspects A, B, and C may have one or more of the following additional elements in combination: Element 1: further including a rotating transmission sleeve coupled between the piston and the mandrel. Element 2: wherein the rotating transmission sleeve includes a helical channel, the helical channel engaging a protrusion on the piston, the helical channel configured to follow the protrusion and rotate the rotating transmission sleeve as the piston moves from the first position to the second position to rotate and angularly translate the deflection tip relative to the housing. Element 3: wherein the distal end of the housing has an angled inner surface. Element 4: further including a ramp coupled on an outer surface of the mandrel, the ramp configured to engage the angled inner surface of the housing and angularly translate the mandrel relative to the housing as the mandrel rotates relative to the housing. Element 5: wherein the housing includes a piston housing and separate eccentric housing, the eccentric housing having the angled inner surface, and further wherein the ramp is an eccentric ramp configured to engage the angled inner surface of the eccentric housing and angularly translate the mandrel relative to the eccentric housing as the mandrel rotates relative to the eccentric housing. Element 6: wherein a longitudinal passageway extends through the piston, the mandrel, and the deflection tip. Element 7: wherein the longitudinal passageway has a minimum diameter (d) of at least 12 mm. Element 8: wherein further including a fluid nozzle assembly positioned within the housing at an uphole end of the piston. Element 9: wherein further including a hydraulic power unit coupled uphole of the piston, the hydraulic power unit configured to mechanically move the piston from the first position to the second position. Element 10: wherein the hydraulic power unit is programmable to mechanically move the piston after one or more pressure cycles thereon. Element 11: wherein the deflection tip is configured to rotate by about 180 degrees and angularly translate by an angle ($\theta$) of at least about 5 degrees as the piston moves from the first position to the second position. Element 12: wherein the deflection tip and the mandrel are separate features. Element 13: wherein moving the piston includes applying an axial force to the piston. Element 14: wherein moving the piston includes applying pressure to the piston by a fluid nozzle assembly positioned within the housing at an uphole end of the piston. Element 15: wherein moving the piston includes mechanically moving the piston using a hydraulic power unit positioned uphole of the piston. Element 16: wherein moving the piston from the first position to the second position at a desired location in the main wellbore to rotate and angularly translate the deflection tip relative to the housing, includes rotating the deflection tip by about 180 degrees and angularly translating the deflection tip by an angle ($\theta$) of at least about 5 degrees relative to the housing. Element 17: wherein the deflection tip and the mandrel are separate features. Element 18: wherein the lateral locating assembly further includes a rotating transmission sleeve coupled between the piston and the mandrel, the rotating transmission sleeve including a helical channel, the helical channel engaging a protrusion on the piston, the helical channel configured to follow the protrusion and rotate the rotating transmission sleeve as the piston moves from the first position to the second position to rotate and angularly translate the deflection tip relative to the housing. Element 19: wherein a longitudinal passageway extends through the piston, the mandrel, and the deflection tip, the longitudinal passageway having a minimum diameter (d) of at least 12 mm. Element 20: wherein the deflection tip and the mandrel are separate features.

Those skilled in the art to which this application relates will appreciate that other and further additions, deletions, substitutions and modifications may be made to the described embodiments.

What is claimed is:

1. A lateral locating assembly, comprising:

a housing;

a piston positioned within the housing;

a mandrel extending from a distal end of the housing, the mandrel configured to rotate and translate angularly in response to the piston moving from a first position to a second position; and a deflection tip coupled with a distal end of the mandrel, the deflection tip configured to rotate and angularly translate with the mandrel relative to the housing.

2. The lateral locating assembly according to claim 1, further including a rotating transmission sleeve coupled between the piston and the mandrel.

3. The lateral locating assembly according to claim 2, wherein the rotating transmission sleeve includes a helical channel, the helical channel engaging a protrusion on the piston, the helical channel configured to follow the protrusion and rotate the rotating transmission sleeve as the piston moves from the first position to the second position to rotate and angularly translate the deflection tip relative to the housing.

4. The lateral locating assembly according to claim 1, wherein the distal end of the housing has an angled inner surface.

5. The lateral locating assembly according to claim 4, further including a ramp coupled on an outer surface of the mandrel, the ramp configured to engage the angled inner surface of the housing and angularly translate the mandrel relative to the housing as the mandrel rotates relative to the housing.

6. The lateral locating assembly according to claim 5, wherein the housing includes a piston housing and separate eccentric housing, the eccentric housing having the angled inner surface, and further wherein the ramp is an eccentric ramp configured to engage the angled inner surface of the eccentric housing and angularly translate the mandrel relative to the eccentric housing as the mandrel rotates relative to the eccentric housing.

7. The lateral locating assembly according to claim 1, wherein a longitudinal passageway extends through the piston, the mandrel, and the deflection tip.

8. The lateral locating assembly according to claim 7, wherein the longitudinal passageway has a minimum diameter (d) of at least 12 mm.

9. The lateral locating assembly according to claim 1, further including a fluid nozzle assembly positioned within the housing at an uphole end of the piston.

10. The lateral locating assembly according to claim 1, further including a hydraulic power unit coupled uphole of the piston, the hydraulic power unit configured to mechanically move the piston from the first position to the second position.

11. The lateral locating assembly according to claim 10, wherein the hydraulic power unit is programmable to mechanically move the piston after one or more pressure cycles thereon.

12. The lateral locating assembly according to claim 1, wherein the deflection tip is configured to rotate by about 180 degrees and angularly translate by an angle (θ) of at least about 5 degrees as the piston moves from the first position to the second position.

13. The lateral locating assembly according to claim 1, wherein the deflection tip and the mandrel are separate features.

14. A method of wellbore intervention, the method comprising:

running a lateral locating assembly into a main wellbore, the lateral locating assembly including:

a housing;

a piston positioned within the housing;

a mandrel extending from a distal end of the housing, the mandrel configured to rotate and translate angularly in response to the piston moving from a first position to a second position; and a deflection tip coupled with a distal end of the mandrel, the deflection tip configured to rotate and angularly translate with the mandrel relative to the housing; and moving the piston from the first position to the second position at a desired location in the main wellbore to rotate and angularly translate the deflection tip relative to the housing; and pushing the lateral locating assembly having the rotated and angularly translated deflection tip through a window in the main wellbore and into a lateral wellbore.

15. The method according to claim 14, wherein moving the piston includes applying an axial force to the piston.

16. The method according to claim 14, wherein moving the piston includes applying pressure to the piston by a fluid nozzle assembly positioned within the housing at an uphole end of the piston.

17. The method on according to claim 14, wherein moving the piston includes mechanically moving the piston using a hydraulic power unit positioned uphole of the piston.

18. The method according to claim 14, wherein moving the piston from the first position to the second position at a desired location in the main wellbore to rotate and angularly translate the deflection tip relative to the housing, includes rotating the deflection tip by about 180 degrees and angularly translating the deflection tip by an angle (θ) of at least about 5 degrees relative to the housing.

19. The method according to claim 14, wherein the deflection tip and the mandrel are separate features.

20. A well system, comprising:

a main wellbore;

a lateral wellbore extending from the main wellbore; and a lateral locating assembly located in the main wellbore, the lateral locating assembly including:

a housing;

a piston positioned within the housing;

a mandrel extending from a distal end of the housing, the mandrel configured to rotate and translate angularly in response to the piston moving from a first position to a second position; and a deflection tip coupled with a distal end of the mandrel, the deflection tip configured to rotate and angularly translate with the mandrel relative to the housing.

21. The well system according to claim 20, wherein the lateral locating assembly further includes a rotating transmission sleeve coupled between the piston and the mandrel, the rotating transmission sleeve including a helical channel, the helical channel engaging a protrusion on the piston, the helical channel configured to follow the protrusion and rotate the rotating transmission sleeve as the piston moves from the first position to the second position to rotate and angularly translate the deflection tip relative to the housing.

22. The well system according to claim 20, wherein a longitudinal passageway extends through the piston, the mandrel, and the deflection tip, the longitudinal passageway having a minimum diameter (d) of at least 12 mm.

23. The well system according to claim 20, wherein the deflection tip and the mandrel are separate features.

* * * * *